United States Patent [19]

Hollander, Jr.

[11] Patent Number: 4,582,451

[45] Date of Patent: Apr. 15, 1986

[54] FLOODGATE PANEL AND SEALING MEANS THEREFOR

[75] Inventor: Theodore C. Hollander, Jr., Sherman, Conn.

[73] Assignee: The Presray Corporation, Pawling, N.Y.

[21] Appl. No.: 600,499

[22] Filed: Apr. 16, 1984

[51] Int. Cl.[4] ..... E02B 7/28; F16K 3/00

[52] U.S. Cl. ..... 405/105; 405/104; 251/328

[58] Field of Search ..... 405/87, 90, 91, 103–106, 405/114; 49/477, 485, 498; 277/34, 34.3; 376/203, 205; 251/172, 326, 328

[56] References Cited

U.S. PATENT DOCUMENTS

| | | | |
|---|---|---|---|
| 2,984,074 | 5/1961 | Le Clair et al. | 405/106 |
| 3,326,002 | 6/1967 | Halpenny | 405/105 |
| 3,371,493 | 3/1968 | Woolley | 405/106 |
| 3,397,490 | 8/1968 | Carlson . | |
| 3,796,010 | 3/1974 | Carlson | 405/106 X |
| 4,220,420 | 9/1980 | Aston et al. | 405/104 |
| 4,355,000 | 10/1982 | Lumelleau . | |

FOREIGN PATENT DOCUMENTS

| | | | |
|---|---|---|---|
| 2127058 | 10/1972 | France | 405/104 |
| 1129662 | 10/1968 | United Kingdom | 405/105 |
| 372314 | 4/1973 | U.S.S.R. | 405/104 |

*Primary Examiner*—Cornelius J. Husar
*Assistant Examiner*—Nancy J. Stodola
*Attorney, Agent, or Firm*—Mandeville and Schweitzer

[57] ABSTRACT

A floodgate structure is disclosed for closing of an hydraulic flow channel at selected times, as during flooding conditions. A gate panel is normally loosely and slideably received in a recess below grade level. To render the gate operational, it is lifted into a channel-blocking position. Pneumatically inflatable peripheral sealing elements extend from the water side of the panel into sealing contact with a fixed support structure. The opposite side of the panel supports a flexible but noninflatable sealing skirt element, which is pressed into sealing contact with the supporting structure by expansion of the inflatable elements. When thus positioned, the sealing skirt becomes hydrostatically loaded by the pressure of the water and functions as an effective seal in the event of subsequent failure of the pneumatically expandable elements.

7 Claims, 6 Drawing Figures

FLOODGATE PANEL AND SEALING MEANS THEREFOR

BACKGROUND AND SUMMARY OF THE INVENTION

The invention is directed to improvements in floodgate structures, for selectively closing off flood access areas during periods of high water inundation. For this service, the gate panel structure remains in a retracted or inoperative position for long periods of time, perhaps more than a year. When high water inundation is anticipated, the floodgate is moved into a position to serve as a barrier against such inundation.

Pursuant to the present invention, an improved floodgate structure is provided in which a particularly advantageous form of sealing means is provided, for sealing the peripheral areas of the gate structure against the flow of water under pressure, when the panel is in its active position and hydrostatic pressure is present.

Pursuant to one aspect of the invention, peripheral portions of the floodgate panel are provided on opposite sides with redundant seals, including a continuous, pneumatically inflatable sealing means on the upstream or pressure side of the floodgate, and a hydrostatically loaded, continuous sealing skirt on the opposite or downstream side of the gate panel. The arrangement of the seals is such that, when the upstream seal is deflated, the gate panel is easily raised and lowered in its guiding and supporting structure. When the gate is in its operative position, the upstream sealing means is inflated, bodily urging the gate panel in a downstream direction to bring the mechanical sealing element into sealing contact with the support structure and mechanically loading that seal sufficiently to make it effective. In the arrangement of the invention, if the panel becomes hydrostatically loaded by a high water condition, the mechanically loaded skirt seal is held in sealing contact with its adjacent structure by the hydrostatic force, as well as by the force of the upstream, inflatable sealing elements. Accordingly, should the upstream elements become deflated for any reason, the seal will be maintained by the hydrostatically loaded skirt seal on the downstream side.

The structure of the invention is both simple and durable, so as to be capable of economically acceptable installation costs, while at the same time being reliably operational under rather severe duty conditions.

For a more complete understanding of the above and other features and advantages of the invention, reference should be made to the following description of a preferred embodiment of the invention, and to the accompanying drawing.

DESCRIPTION OF A PREFERRED EMBODIMENT

Figures 1, 5:
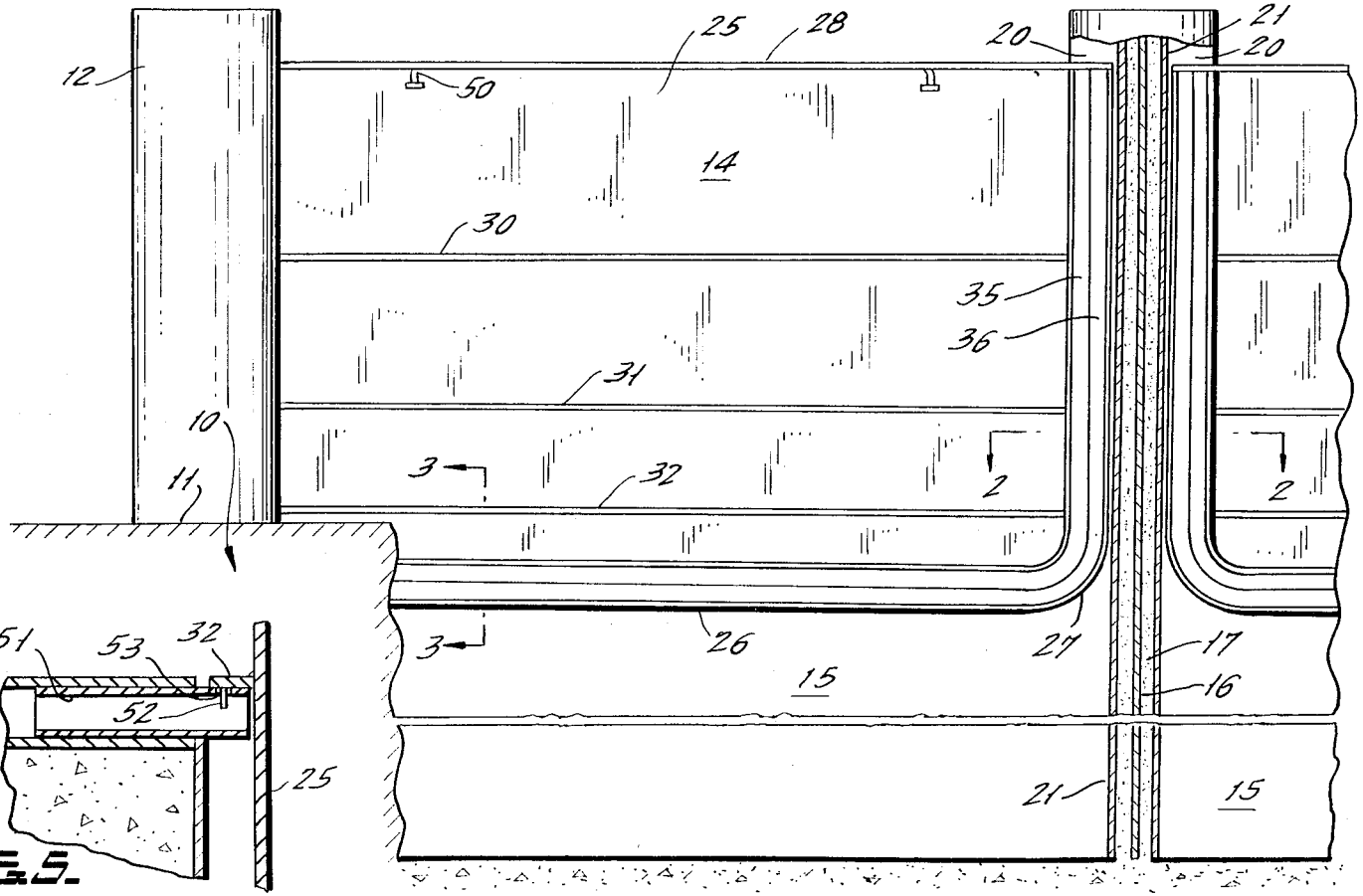
FIG. 1 is an elevational view, partly in section, of a floodgate installation incorporating features of the invention.
FIG. 5 is an enlarged, fragmentary illustration of a mechanical locking arrangement for supporting the gate panel in an upraised position.

Referring now to the drawings, and initially to FIG. 1 thereof, the reference numeral 10 designates generally the ground area to be protected by the new floodgate. The area has a finish grade level 11 and is provided with a plurality of laterally spaced gate supports or pylons 12 which extend, like fence posts, across the flood plain area. At the extremities (not shown) the final pylon is joined by a levy, where appropriate, or by an elevated natural grade level, where there is no need for floodgate panels.

Each pair of support pylons 12 is provided with opposed, facing vertical channels or guide grooves 20, arranged to both guide and support a floodgate panel, generally designated by the numeral 14. Directly below the pylon supports 12, and between each pair thereof, there is provided a deep, narrow recess 15, typically lined with concrete or sheet steel, the height and width dimensions of which are sufficient to contain the entire floodgate panel 14 below the finish grade level 11, when the panels are not in active use.

In a typical installation, the support pylons 12 may comprise a heavy I-beam member 16, which is embedded in concrete and extends well below the grade level 11, to provide adequate strength and overturning resistance to support a substantial floodgate panel 14 against the hydrostatic pressure of food waters. The lower portion of the I-beam 16 is anchored in foundation concrete, while the upper portion is surrounded by a post-like concrete cylinder 17. In a typical installation, the concrete cylinder might be on the order of 24 inches in diameter, while the embedded I-beam 16 might approximate 2 inches in flange width and 12 inches in web height, for example. Width between the center lines of adjacent pylons 12 might range typically from about six feet to as much as about twenty-six feet, and the gate height from grade level might typically be on the order of six to ten feet, although the invention is by no means restricted to specific panel dimensions. The structure and arrangement of the pylons 12 does not, per se, form any part of the invention.

Figure 2:
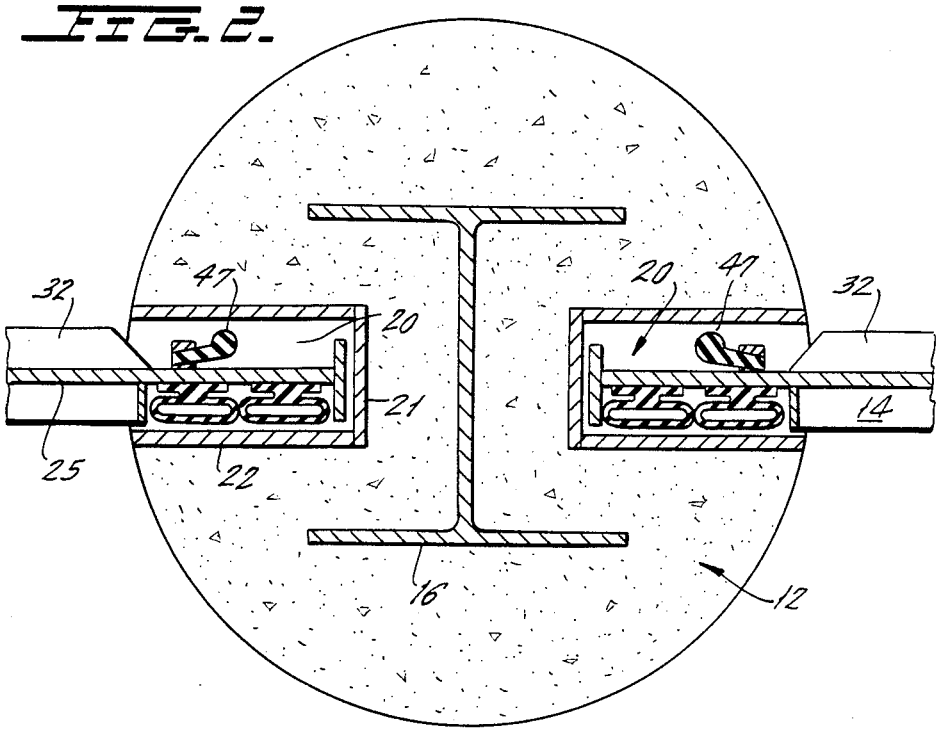
FIG. 2 is a cross sectional view as taken generally on line 2—2 of FIG. 1.

As reflected particularly in FIG. 2, the concrete portions 18 of the pylons 12 are provided with opposed pairs of the outwardly opening, vertically extending guide grooves 20, arranged to receive the vertical edge portions of the floodgate panels 14. In a typical case, the guide grooves may be on the order of nine inches deep, with a width of perhaps five inches. As shown in FIG. 2, the guide grooves freely and loosely receive the edge portions of the gate panels. The recesses 15, extending below grade level, typically will be of the same width as the guide grooves 20, and constitute more or less a continuation of such grooves except that, below the grade level 11, the grooves turn into continuous side-to-side slots adapted to receive and contain an entire panel.

Figure 3:
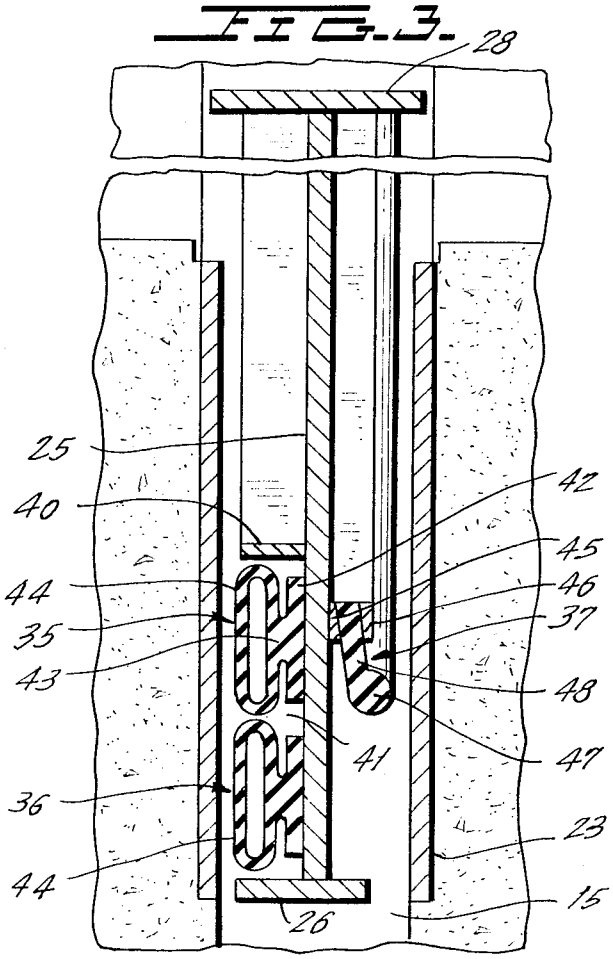
FIGS. 3 and 4 are enlarged, fragmentary cross sectional views as taken generally on line 3—3 of FIG. 1, with the gate being raised in FIG. 3 and lowered in FIG. 4.
Figure 4:
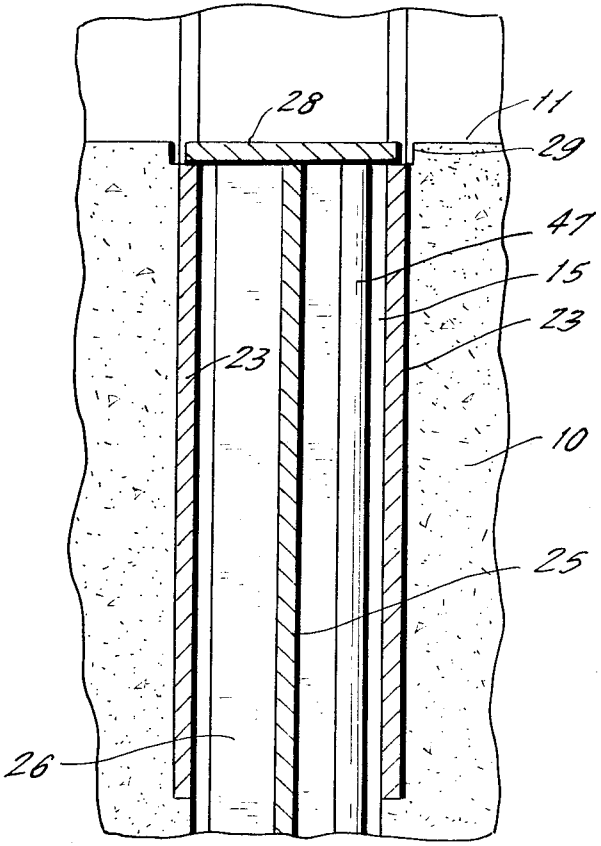

In the illustrated installation, the pylon grooves 20 are provided at their inside or "bottom" surfaces with a metal lining plate 21, extending to the bottom of the slot-like recess 15. The sides of the grooves 20 are also lined with metal plates 22, but these, in a typical case, may extend only to grade level 11 or slightly below. The upper margin of the slot-like recess 15 is, however, provided with an inlaid metal liner plate 23 on each side, as shown in FIGS. 3 and 4. The arrangement of the liner plates 22, 23 is such that, when the floodgate panel 14 is in its raised and operative position, its side and bottom margins lie adjacent to the respective liner plates 22, 23.

In the gate panel structure of the illustrated installation, there is provided a large, flat metal panel 25, of a size and shape to occupy the entire rectangular space between adjacent pylons 12 and the finish grade level 11, with margins extending into the respective guide grooves 20 and into the upper portion of the slot-like recess 15. The panel 25 is structurally reinforced about its side and bottom edges by a peripheral flange 26, which extends continuously down one side, across the bottom and up the other side, with generously rounded corner areas 27. A top peripheral flange 28 extends across the top of the panel and is of a width slightly greater than the width of the slot-like recess 15. Accordingly, as shown in FIG. 4, when the gate panel 14 is in its lowered or recessed position, the upper peripheral flange 28 rests upon the upper edges of the metal facing panels 23, substantially closing and sealing the slot-like recess 15 against the entry of debris. Typically, the finish grade level 11 may be slightly recessed at 29 sufficiently to allow the upper peripheral flange to be flush with the upper surface of the finish grade.

Additional reinforcement of the panel 14 is provided by transverse intermediate flanges 30, 31, 32 that typically may be welded to the opposite faces of the main panel 25.

Pursuant to one of the features of the invention, the side and bottom peripheral margins of the gate panel 14 are provided with upstream and downstream sealing means, each of a different kind and having a slightly different function. The upstream and downstream sealing means provide a desirable redundancy, such that failure of one of the seals does not result in failure of the flood protection. The primary sealing means is provided by pneumatically inflatable resilient sealing elements 35, 36, which are located on the upstream side of the panel 14. A secondary sealing means, in the form of a mechanically and hydrostatically loaded skirt-like sealing element 37, sometimes referred to as a "J"-gasket is provided on the downstream peripheral face of the panel and functions as a fully effective back-up seal, in the event of failure of the inflatable seal elements.

In the illustrated form of the invention, a confining channel is provided around the upstream peripheral edge of the panel 14 by means of the outer peripheral flange 26, on the outside, and a parallel, continuous flange 40 extending from the upstream face of the panel plate 25, spaced inward a distance of eight inches or so from the peripheral flange 26. The two flanges 26, 40 thus define an upstream-facing channel 41 extending continuously about the sides and bottom of the panel 14. Mounted within the channel 41, and extending continuously around the sides and bottom peripheral margin of the panel 14 are elastic, pneumatically inflatable sealing elements 35, 36, which are shown in cross section in FIGS. 2 and 3. Although the form of the pneumatic sealing elements is not critical to the invention, an advantageous cross sectional configuration includes a continuous mounting flange 42, which is connected by a central spacing neck 43 to oval-shaped, pneumatically expandable outer portions 44. The described sealing elements may be conveniently mounted to the panel plate 25 in accordance with the teachings of the Carlson U.S. Pat. No. 3,397,490, assigned to The Presray Corporation, Pawling, N.Y.

As reflected in FIGS. 2 and 3, when the inflatable portions 44 are depressurized, they assume a low profile configuration, confined substantially within the limits of the confining channel 41. Pursuant to the invention, the pneumatically expandable elements are mounted on the upstream face of the panel plate 25.

On the downstream face of the panel plate, the "J"-gasket 37 is mounted in cantilever fashion by clamping elements 45, 46. The "J"-gasket has an enlarged, bulb-like section 47 at its free end, which is connected by a short, laterally extending skirt section 48 to the clamping bars 45, 46. Desirably, the connecting skirt extends from the clamping bars 45, 46 generally toward the peripheral flange 26, and preferably at a slight angle away from the panel plate 25.

As reflected particularly in FIGS. 2 and 3, the cross sectional geometry of the peripheral area of the panel 14 is arranged to accommodate the different types of seals employed on the upstream and downstream sides of the panel. Thus, the peripheral flange 26, and the parallel, channel-forming flange 40 extend outward from the panel plate 25 a distance sufficient to substantially fully recess the inflatable sealing elements 35, 36 in their depressurized condition. On the downstream face of the panel, however, the geometry of the peripheral flange 26 and the clamping bars 45, 46 is such as to cause the bulb-like extremity 47 of the "J"-gasket to project perhaps a half inch or so outwardly beyond the limits of the plane defined by the downstream edge of the peripheral flange 26.

Overall, when the inflatable elements 35, 36 are depressurized, the effective thickness of the assembled gate panel 14 is somewhat less, perhaps about one inch less, than the width of the channels 20 and slot-like recess 15. Accordingly, the gate panel may be freely raised and lowered within the guide slots for either activating or retracting the panel.

In order to put the panels into active use, they are lifted from their fully retracted positions, contained entirely within the slot-like recesses 15, to the upraised positions shown in FIG. 1. To this end, suitable lifting handles 50 are provided along the upper edge, which may be engaged by a crane or hoist to lift the panels into operative position. Desirably, a latch arrangement, such as a restractable slide bar 51 may be provided adjacent the pylons 12, for engagement with the lower reinforcing flanges 32. These enable the gate panels to be mechanically self-holding in active position, after being lifted to such positions by external means. To activate the slide bars, the gate is first lifted slightly above its "active" position, allowing slide bars at each side of the panel to be moved into locking position (see FIG. 5). Retaining pins 52, extending from the flanges 32, are received in openings 53 in the respective slide bars 51, to prevent unintentional dislodgement of the latter.

Once the panels have been lifted into position, the inflatable sealing elements 35, 36 are pressurized from a suitable pressure fluid source, typically compressed air. In this respect, it will be understood that the inflatable elements are appropriately sealed and provided with valve means for pressurizing and depressurizing.

Figure 6:
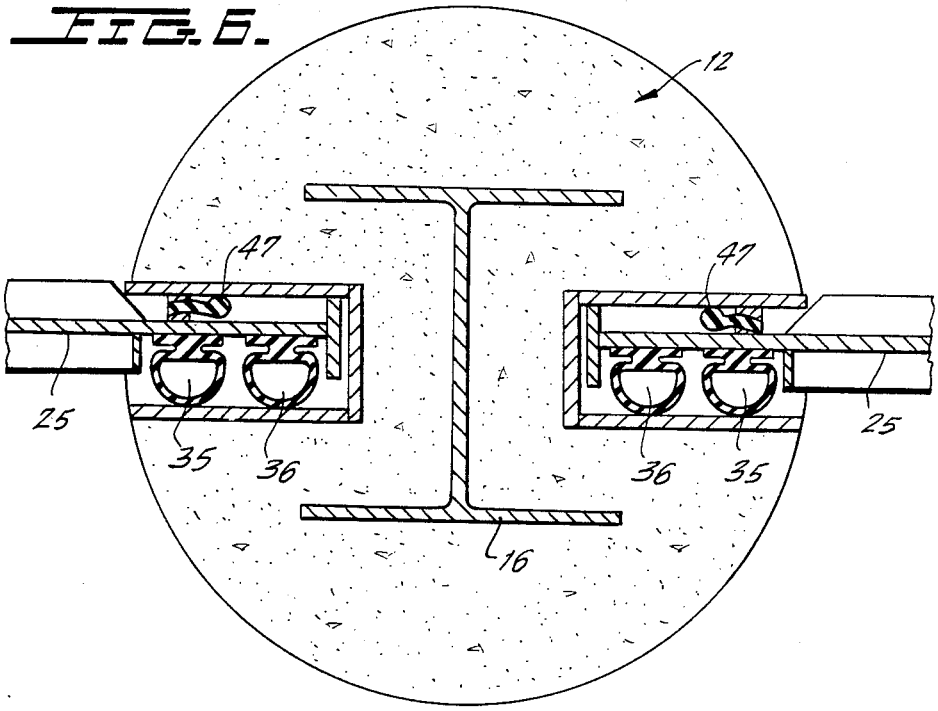
FIG. 6 is a cross sectional view, similar to FIG. 2, but with the sealing elements inflated.

As the inflatable elements are pressurized, they are expanded into a more rounded configuration, as shown in FIG. 6. As this occurs, the panel assembly 14 is displaced in a downstream direction. After the first half inch or so of travel, the bulb-like free end portion of the "J"-gasket engages the downstream line plates 22, 23, and the free end of the gasket is thus restrained, while the remainder of the panel assembly continues to be displaced in a downstream direction. Eventually, the downstream end edge of the peripheral flange 26 bottoms against the liner plates 22, 23, as does the outer surface of the clamping bar 46, and this forms a mechanical limit condition for downstream movement of the panel. In this limit condition, the "J"-gasket is considerably deflected, such that a preloaded pressure seal is provided between the bulbous end 47 of the gasket and the downstream liner plates against which it is pressed. As shown in FIG. 6, however, the thickness of the J-seal bulb is somewhat less than the height of the flange 26 and/or clamping bar 46. Thus, when the panel reaches its downstream limit condition, there is at least some clearance between the upstream face of the J-seal 37 and the downstream face of the panel (see FIG. 6). Thus, upon the escape of any water past the inflatable seals 35, 36, through failure of the seals or even low-level leakage, the J-seal will become hydrostatically loaded on the upstream side providing enhancement of the seal.

On the opposite side of the panel plate 25, the pressurized inflatable members 35, 36 press tightly against the upstream linerplates 22, 23, forming a tight, primary seal about the entire side and bottom peripheral margin of the panel. As and when the panel becomes hydrostatically loaded by the presence of water against the upstream surface, the inflatable sealing members 35, 36, while retaining their sealing function, are no longer required to provide mechanical preloading of the "J"-gasket 37 on the downstream side. The aggregate forces of the restrained water are more than ample for this purpose. Thus, in the event of a failure of one of the inflatable seals 35, 36, as by slow leakage of the pressurized contents over a period of time, the gate panel 14 is nevertheless held firmly against the downstream liner plates 22, 23, by the hydrostatic forces that act on the upstream side of the panel. In addition, as failure occurs in the pneumatic elements, there will be leakage of water around the upstream sealing margins, and this water will flow around the edges of the panel 14 until it encounters the upstream face of the "J"-gasket 37 enhancing the sealing action of the gasket as above described. Accordingly, a fully effective redundant seal remains, even if there is a failure of the primary sealing means.

The apparatus of the invention is uniquely adapted for the particular service for which it is primarily intended, in that it is simple and rugged, capable of withstanding a great deal of neglect after its initial intallation and yet will be reliably operational if and when a flood emergency arises. The provision of redundant seals on the upstream and downstream faces of the panel, with the upstream seals being activated by inflation, and the downstream seals being mechanically preloaded, is uniquely suited for the kind of service contemplated. When the panels are activated for use, they can be easily raised into active position, and the sealing elements quickly made effective by pressurizing the inflatable elements on the upstream side. During the inflation procedures, as the panel shifts in a downstream direction, it rigidly "bottoms" against the downstream panel plates 22, 23, after which the pressurized inflatable elements react against a fixed reference position, enabling significant sealing pressure to be applied between the upstream liner plates and the panel plate 25. At the same time, the downstream seal is mechanically preloaded and readied to perform its secondary sealing function, in the event of failure of the primary seals.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A flood barrier structure which comprises (a) support means forming spaced, opposed pairs of confining recesses, (b) a floodgate panel slideable in said recesses between active and inactive positions, (c) sealing means extending around the side and bottom peripheral margins of said panel, on both the upstream and downstream sides, (d) means including said confining recesses forming sealing surfaces arranged in confronting relation to said peripheral margins when said panel is in its active position, (e) the sealing means on the upstream face of said panel comprising inflatable elastomeric means expandable in an upstream direction when pressurized, (f) the sealing means in the downstream face of said panel comprising a non-pressurized elastomeric member, (g) said panel being moveable in said recesses when said inflatable sealing means is not pressurized, (h) said non-pressurized elastomeric member being movable into sealing pressure contact with confronting sealing surfaces upon pressurization of said inflatable sealing means and being maintainable in such contact by mechanical and hydrostatic pressure against the upstream face of said panel, (i) abutment means on the downstream face of said panel engageable with confronting surfaces of said support means for limiting downstream displacement of said panel under load, (j) said abutment means and said non-pressurized sealing means being so arranged and related that said sealing means is deformed into sealing pressure engagement with confronting sealing surfaces of said support means before movement of said panel is limited by said abutment means, (k) said non-pressurized sealing means comprising a continuous elastomeric element mounted to said panel adjacent one edge in cantilever fashion and extending in a direction generally toward the peripheral side and bottom edges of said panel, (l) the free edge of said continuous element being engageable about the peripheral margin of its downstream face with the confronting surfaces on the downstream side of said panel, (m) said continuous element remaining exposed on its upstream face to unbalanced hydrostatic pressure when said abutment means are engaged with said confronting surface.

2. A structure according to claim 1, further characterized by (a) said support means including means forming a slot-like recess below grade level and of a size and shape to receive the entirety of said panel, p1 (b) the opposite side edge portions of said slot-like recess joining with and forming continuations of said confining recesses.

3. A structure according to claim 2, further characterized by (a) said panel having an upper peripheral flange extending along its upper edge, (b) said upper peripheral flange being of a size and shape to close off the upper end of said slot-like recess when said panel is received therein.

4. A floodgate panel assembly for use in a flood barrier structure of a type having support means forming spaced, opposed pairs of guide means and wherein said floodgate panel is slideable in said guide means between active and inactive positions, said panel comprising (a) a panel plate of a size and shape to form a barrier wall between adjacent support means, (b) sealing means extending around the side and bottom peripheral margins of said panel plate, on both the upstream and downstream sides, (c) the sealing means on the upstream face of said panel plate comprising an effectively continuous elastomeric member expandable in an upstream direction when pressurized, (d) the sealing means on the downstream face of said panel comprising an effectively continuous, non-expanding elastomeric member, (e) said panel having front-to-back dimensions such as to be movable in said guide means when said expandable sealing means is not expanded, (f) said non-expanding elastomeric member being elastically deformable into sealing pressure contact with confronting sealing surfaces of said guide means upon expansion of said expandable sealing means and being maintainable in such contact by hydrostatic pressure against the upstream face of said panel, (g) said non-expanding elastomeric member being mounted in cantilever fashion with its free edge portion extending toward the periphery of said panel, (h) the upstream face of said cantilever-mounted member being exposed to unbalanced hydrostatic pressure and being pressed thereby into sealing contact with said confronting surfaces.

5. A floodgate panel according to claim 4, further characterized by (a) a peripheral flange extending about the side and bottom edges of said panel plate and extending outwardly therefrom in both upstream and downstream directions, (b) said non-expanding sealing means having portions extending from said panel plate in a downstream direction for a distance beyond the downstream extremities of said peripheral flange, whereby to be engaged and displaced by said confronting surfaces.

6. A flood barrier, which comprises (a) a support structure comprising pairs of spaced, generally upright supports and intervening grade level structure collectively defining respective upstream and downstream sealing surfaces, (b) a floodgate panel assembly positionable in said support structure and of a size and shape to have side and bottom peripheral margins positioned between and confronting said sealing surfaces, (c) relatively rigid abutment means extending from the downstream face of said panel and operative to limit movement of the panel in a downstream direction, (d) a downstream sealing element mounted on the downstream face of said panel and extending continuously along said peripheral margin, (e) said downstream sealing element normally projecting beyond the limits of said abutment means and being engageable with and deformable by said downstream sealing surfaces in response to the application of forces to said panel in a downstream direction, and (f) an upstream sealing element mounted on the upstream face of said panel and extending continuously along said peripheral margin, (g) said upstream sealing element being controllably expandable in an upstream direction, (h) said panel and said support structure being so arranged and related that controllable expansion of said upstream sealing element functions to displace said panel in a downstream direction and to establish sealing contact of the upstream and downstream sealing elements with the respective sealing surfaces confronting said sealing elements, (i) said downstream sealing element being mounted in cantilever fashion along one edge and extending from such edge in a direction angled away from the downstream face of the panel and toward the edges of the panel, (j) the outer edge portions of said downstream sealing element being deflectable toward the panel face upon movement of the panel to a downstream limit position.

7. A flood barrier according to claim 6, further characterized by (a) said downstream sealing element being relatively stiff to provide resistance against deflection, and (b) the upstream face of said downstream sealing element being spaced from the downstream face of said panel, when said panel is in a downstream limit position, to enable the restrained liquid to act directly on the upstream face of said downstream sealing element in the event of failure of the upstream sealing means.

* * * * *